US008172103B2

(12) United States Patent
Spyros et al.

(10) Patent No.: US 8,172,103 B2
(45) Date of Patent: May 8, 2012

(54) CONTAINER FOR REFRESHMENT AND SNACKS

(76) Inventors: Paul W. Spyros, Haymarket, VA (US); Nicholas Spyros, Haymarket, VA (US)

( * ) Notice: Subject to any disclaimer, the term of this patent is extended or adjusted under 35 U.S.C. 154(b) by 851 days.

(21) Appl. No.: 11/494,804

(22) Filed: Jul. 28, 2006

(65) Prior Publication Data

US 2008/0023473 A1 Jan. 31, 2008

(51) Int. Cl.
*A47G 19/00* (2006.01)

(52) U.S. Cl. ..... 220/23.86; 220/212.5; 220/705; 206/217

(58) Field of Classification Search ..... 220/23.86, 220/212.5, 212, 705; 206/214, 217, 541; 215/388
See application file for complete search history.

(56) References Cited

U.S. PATENT DOCUMENTS

| | | | | |
|---|---|---|---|---|
| 3,323,706 | A | 6/1967 | Gereke | |
| 3,966,102 | A | 6/1976 | Clark | |
| 4,583,680 | A * | 4/1986 | Gordon et al. | 229/125.28 |
| 4,946,094 | A * | 8/1990 | Stang | 224/270 |
| 5,137,210 | A | 8/1992 | Hibbs | |
| 5,180,079 | A | 1/1993 | Jeng | |
| 5,540,333 | A * | 7/1996 | Gonzalez et al. | 206/541 |
| 5,573,131 | A * | 11/1996 | Berjis | 220/4.03 |
| 5,695,052 | A * | 12/1997 | Damato | 206/217 |
| 5,697,707 | A * | 12/1997 | Esposito | 383/38 |
| 5,725,117 | A | 3/1998 | Berjis | |
| 5,775,570 | A | 7/1998 | Kim | |
| 5,850,911 | A * | 12/1998 | Pakzad | 206/217 |
| 6,269,949 | B1 * | 8/2001 | Gottlieb | 206/519 |
| 6,338,417 | B1 * | 1/2002 | Ferraro | 220/23.83 |
| 6,382,449 | B1 * | 5/2002 | Kazmierski et al. | 220/4.03 |
| 6,394,265 | B1 | 5/2002 | Tsao | |
| 2005/0133580 | A1 * | 6/2005 | Cai | 229/400 |

OTHER PUBLICATIONS

Fast Food Cup, http://farm3.static.flickr.com/2735/4016101564_4536e90a00_b.jpg.*
International Search Report PCT/US 07/10210 filed Apr. 27, 2007.

* cited by examiner

*Primary Examiner* — Anthony Stashick
*Assistant Examiner* — Jeffrey Allen
(74) *Attorney, Agent, or Firm* — Squire Sanders (US) LLP

(57) ABSTRACT

A portable assembly includes a container including top and bottom openings. The portable assembly includes a locking mechanism having a notched shape positioned at a predetermined distance from the bottom opening of the container and a candy pocket. A second locking mechanism may be also provided using tabs. The cup covered and fastened onto a lid is slipped into the container through the bottom opening thereof, over the locking mechanism, and lowered so the cup and the lid latch onto the locking mechanism supporting or holding the cup and lid in place. The cup and the lid enclose the bottom opening of the container to allow the container to be filled with a snacking food. A handle is attached to opposite sides of the container configured to enable a person to carry together the container, the cup, and the candy.

21 Claims, 9 Drawing Sheets

CONTAINER FOR REFRESHMENT AND SNACKS

BACKGROUND OF THE INVENTION

1. Field of the Invention

The present invention relates to a portable snack container configured to enable a person to carry multiple refreshment types, such as a drink and snacks, as a unit.

2. Description of the Related Art

Many consumers often buy multiple refreshments, such as a soft drink, along with a snacking food like pretzels, popcorn, nuts, fries, or potato chips at many establishments, such as restaurants, movie theatres, concert halls, stadiums, convenience stores, amusement parks, and theme parks. Even though these items are bought together, they are sold in separate containers. This is not very convenient for a consumer who has to use both hands to carry all the containers. It would be more convenient to have one container which could carry the refreshment and snack food items.

Many establishments have employed the use of cardboard trays which hold many of these items together. However, these trays can only hold a limited amount of snack food and a small cup size for the refreshment. Also, these trays cannot be placed in the cup holders usually available in theaters, stadiums, and the like, thereby forcing the consumer to either place the tray on the floor or on his/her lap increasing the chances of spills and waste.

For instance, at a theatre or a stadium, one usually purchases a paper bag or a paper bucket of popcorn and a paper cup of refreshment. After this purchase, one needs to carry the popcorn and refreshment with other personal items, open at least one door to the theater, and maneuver through people to get to the theatre seat. After reaching the theatre seats, one needs to pull down the seat in order to sit down. As it can be seen, it is very difficult to handle all of these items with two hands. Because of this problem, people tend to spill the refreshment and the popcorn onto the ground.

Thus, a container is needed that would enable a person to carry the refreshment and snack foods using a portable assembly. Such assembly could fit in a cup holder.

SUMMARY OF THE INVENTION

According to an embodiment of the present invention, there is provided a portable assembly, including a container including top and bottom openings, a locking mechanism having a notched shape positioned at a predetermined distance from the bottom opening of the container, a pocket on an outside wall of the container configured to hold a dry snack, a vessel, and a lid configured to cover and fasten onto the vessel. The vessel and the lid are slipped into the container through the bottom opening, over the locking mechanism, and lowered so the vessel and the lid latch onto the locking mechanism supporting or holding the vessel and lid in place. The vessel and the lid enclose the bottom opening of the container to allow the container to be filled with a snacking food. A handle is operatively attached to opposite sides of the container configured to enable a person to carry as a unit the container, the vessel, and the dry snack.

According to an embodiment of the present invention, there is provided a portable assembly, including a container including top and bottom openings, a first locking mechanism including a slit cut on the container, a first tab, and a pre-cut secondary tab formed on the first tab, a pocket on an outside wall of the container configured to hold a dry snack, a vessel, and a lid configured to cover and fasten onto the vessel. The vessel and the lid are slipped into the container through the bottom opening, the first tab is lined up with the slit on the container, the first tab is pulled away from the container and flipped in an upward direction, and the secondary tab is inserted into the slit to secure the vessel to the container. The vessel and the lid enclose the bottom opening of the container to allow the container to be filled with a snacking food. A handle is operatively attached to opposite sides of the container configured to enable a person to carry as a unit the container, the vessel, and the dry snack.

According to an embodiment of the present invention, there is provided a portable assembly, including a container including a top opening and a base, a retainer attached to an inside wall of the container, a pocket on an outside wall of the container configured to hold a dry snack, a vessel configured to fit in the container, and a lid configured to cover and fasten onto the vessel. The vessel is positioned within the retainer to secure the vessel to the container and the container is filled with a snacking food. A handle is operatively attached to opposite sides of the container configured to enable a person to carry as a unit the container, the vessel, and the dry snack.

According to an embodiment of the present invention, there is provided a portable assembly, including container means including top and bottom openings, locking mechanism means having a notched shape positioned at a predetermined distance from the bottom opening of the container means, holding means on an outside wall of the container means for holding a dry snack, vessel means, and lid means for covering and fastening onto the vessel. The vessel means and the lid means are slipped into the container means through the bottom opening, over the locking mechanism means, and lowered so the vessel means and the lid means latch onto the locking mechanism means for supporting or holding the vessel means and the lid means in place. The vessel means and the lid means are provided for enclosing the bottom opening of the container means to allow the container means to be filled with a snacking food. The portable assembly includes handle means operatively attached to opposite sides of the container means for enabling a person to carry as a unit the container means, the vessel means, and the dry snack.

According to an embodiment of the present invention, there is provided a portable assembly, including container means including top and bottom openings, first locking mechanism means including a slit cut on the container means, a first tab, and a pre-cut secondary tab formed on the first tab, pocket means on an outside wall of the container means for holding a dry snack, vessel means, and lid means for covering and fastening onto the vessel means. The vessel means and the lid means are slipped into the container means through the bottom opening, the first tab is lined up with the slit on the container means, the first tab is pulled away from the container means and flipped in an upward direction, and the secondary tab is inserted into the slit to secure the vessel means to the container means. The vessel means and the lid means are provided for enclosing the bottom opening of the container means to allow the container means to be filled with a snacking food. The portable assembly also includes handle means operatively attached to opposite sides of the container for enabling a person to carry as a unit the container means, the vessel means, and the dry snack.

According to an embodiment of the present invention, there is provided a portable assembly, including container means including a top opening and a base, retainer means attached to an inside wall of the container means, pocket means on an outside wall of the container means for holding a dry snack, vessel configured to fit in the container means, and lid configured to cover and fasten onto the vessel means. The vessel is positioned within the retainer means to secure the vessel means to the container means and the container means is filled with a snacking food. The portable assembly also includes handle operatively attached to opposite sides of the container means for enabling a person to carry as a unit the container means, the vessel means, and the dry snack.

According to an embodiment of the present invention, there is provided a method for assembling a portable unit, including providing a container including top and bottom openings, positioning a locking mechanism having a notched shape at a predetermined distance from the bottom opening of the container, holding a dry snack using a pocket on an outside wall of the container, covering and fastening a vessel using a lid, and slipping the vessel and the lid into the container through the bottom opening, over the locking mechanism. The method further includes lowering the vessel and the lid so the vessel and the lid latch onto the locking mechanism supporting or holding the vessel and lid in place, enclosing the bottom opening of the container using the vessel and the lid to allow the container to be filled with a snacking food, and operatively attaching a handle to opposite sides of the container configured to enable a person to carry as a unit the container, the vessel, and the dry snack.

According to an embodiment of the present invention, there is provided a method for assembling a portable unit, including providing a container including top and bottom openings, providing a first locking mechanism including a slit cut on the container, a first tab, and a pre-cut secondary tab formed on the first tab, holding a dry snack using a pocket on an outside wall of the container, and covering and fastening a vessel using a lid, and slipping the vessel and the lid into the container through the bottom opening, over the locking mechanism. The method further includes lining up the first tab with the slit on the container, pulling the first tab away from the container, flipping the first tab in an upward direction, inserting the secondary tab is inserted into the slit to secure the vessel to the container, enclosing the bottom opening of the container using the vessel and the lid to allow the container to be filled with a snacking food, and operatively attaching a handle to opposite sides of the container configured to enable a person to carry as a unit the container, the vessel, and the dry snack.

According to an embodiment of the present invention, there is provided a method for assembling a portable unit, including providing a container including a top opening and a base, attaching a retainer to an inside wall of the container, holding a dry snack using a pocket on an outside wall of the container, covering and fastening a vessel using a lid, wherein the vessel is configured to fit in the container, and positioning the vessel within the retainer to secure the vessel to the container. The method further includes filling the container with a snacking food, and operatively attaching a handle to opposite sides of the container configured to enable a person to carry as a unit the container, the vessel, and the dry snack.

BRIEF DESCRIPTION OF THE DRAWINGS

Further embodiments, details, advantages and modifications of the present invention will become apparent from the following detailed description of the preferred embodiments which is to be taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. The embodiments of the present invention described below provide a portable snack food assembly, unit, or container. The portable container allows a person to carry refreshments and snacks single hand reducing spills or waste. The portable container may be formed partially or completely out of a sheet of thin material, such as paperboard, paper stock, corrugated, plastic, synthetic material, or combinations thereof.

Figure 1:
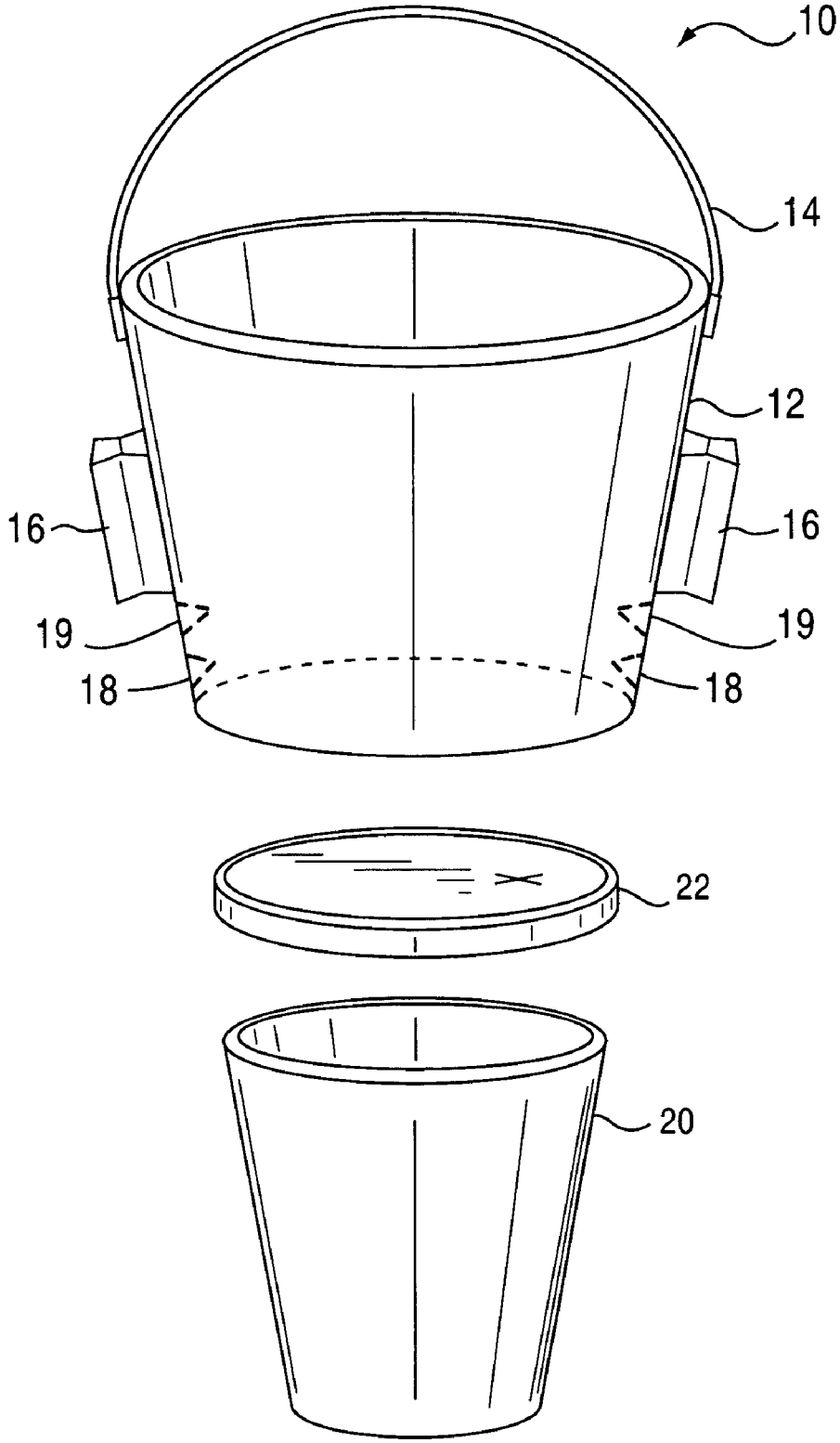
FIG. 1 illustrates a portable container including a container having a trapezoidal cylindrical shape with top and bottom openings, in accordance with an embodiment of the present invention.

FIG. 1 illustrates a portable container 10 including a container 12 having a trapezoidal cylindrical shape with top and bottom openings, in accordance with an embodiment of the present invention. In one embodiment, the diameter of the top opening may be wider than the diameter of the bottom opening. The container 12 includes a handle 14 operatively attached to opposite sides of the container 12. Any well known connector may be used to attach the handle to the container 12. The handle 14 may be detachable from the connector and the combination of such connector and handle 14 may be removable and sufficiently strong to carry the container 12 and its contents as an integrated portable unit.

First and second locking mechanisms 18 and 19, each having a notched shape, may be positioned at a predetermined distance from the bottom opening of the container. The first and second locking mechanisms 18 and 19 are used to lock and/or hold a cup in place to enable a person to carry together the refreshment and the container 12 filled with any type of snack food such as popcorn, for instance, using the handle 14. The first and second locking mechanisms 18 and 19 would prevent the cup from sliding down from the container 12.

Further, the first and second locking mechanisms 18 and 19 may be build inside the walls of the container 12 or may be perforated through the container 12 walls so that a person assembling the portable container 10 would push the perforations inwards of the container 12 to form the first and second locking mechanisms 18 and 19 within the container 12. A distance between the first locking mechanism 18 and the second locking mechanism 19 would be such to be able to hold in place a combination of a cup and lid or cup only. In one embodiment, the distance between the first locking mechanism 18 and the second locking mechanism 19 may equal to the thickness of the lid or the thickness of a rim of the cup and lid.

Any number of the first locking mechanism 18 and/or the second locking mechanism 19 may be provided. For illustrative purposes, two first and second locking mechanisms 18 and 19 on opposite sides of the inner walls of the container 12 are illustrated in the figures of the present application. In addition, although the first locking mechanism 18 and 19 are illustrated and described, a person of ordinary skill in the art will appreciate that a single locking mechanism 18 may be provided on opposite sides of the inner walls of the container.

Furthermore, a person of ordinary skill in the art will appreciate that the first and second locking mechanisms 18 and 19, each having a notched shape, may be positioned at a predetermined distance from a top opening of a vessel or drinking cup. The side walls of the container 12 would be configured to receive the first and second locking mechanisms 18 and 19 through either perforated slits or the like and lock with the first and second locking mechanisms 18 and 19 to prevent the cup from sliding down from the container 12.

Figure 2:
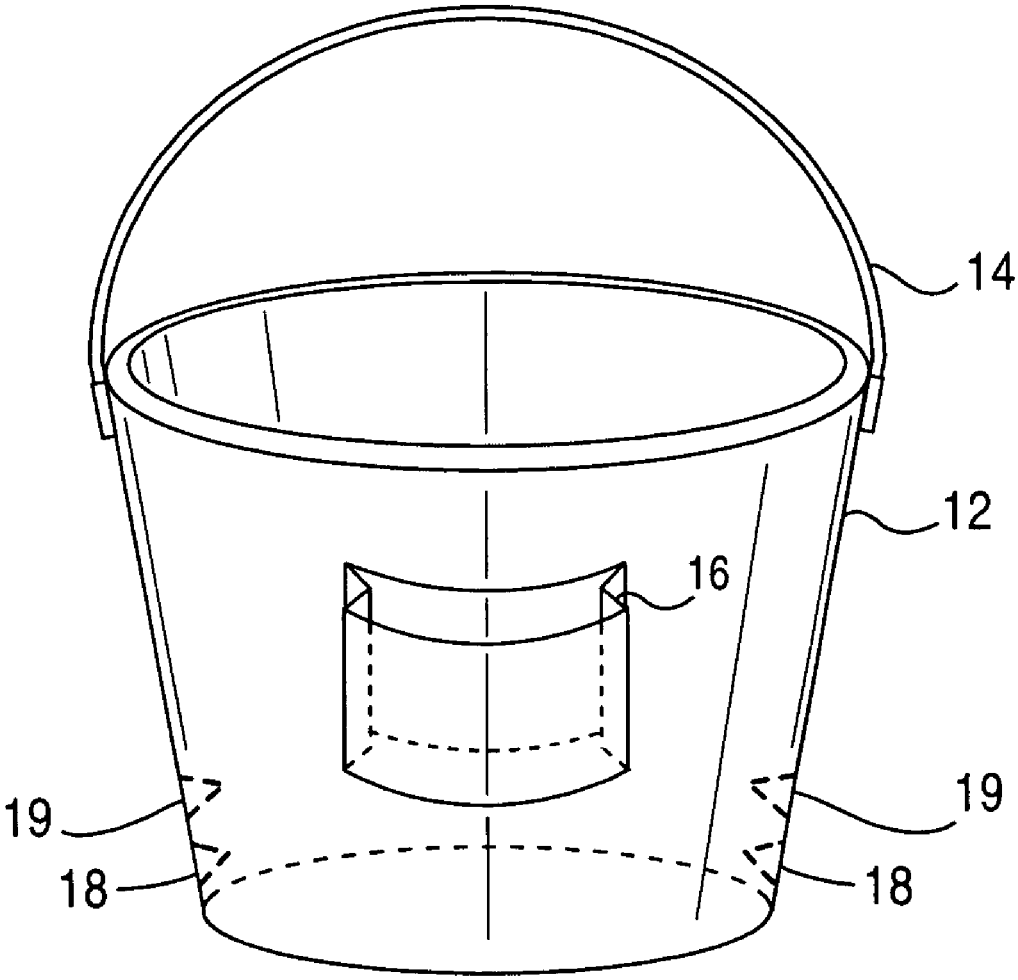
FIG. 2 illustrates a frontal view of a candy holder operatively attached to the container, in accordance with an embodiment of the present invention.

Further, on outside walls of the container 12, at least one pocket or holder 16 is provided having a size large enough to carry any type of dry snack such as candies, candy boxes, nuts, pretzels, or other similar type of snacks. FIG. 2 illustrates a frontal view of the candy holder 16 operatively attached to the container 12, in accordance with an embodiment of the present invention. Prior to assembly of the portable container 10, the candy holder 16 may be in a folded position. While assembling the container 10 for use, the candy holder 16 may be outwardly extended. The at least one candy holder 16 may be placed at any position along a circumference of the container 12 and may also be placed at any position along a vertical height from the bottom opening of the container 12. For illustrative purposes, two candy holders 16 are provided on opposite outside walls of the container 12.

As illustrated in FIG. 1, a vessel or drinking cup 20 is to be positioned at the bottom opening of the container 12. The vessel 20 may include a cup, a vase, a pitcher, or any other similar types of containers for holding any type of liquid. The lid 22 would be covered and fastened onto the top opening of the cup 20 for retaining the refreshment therein. The lid 22 is typically made of styrene or some other kind of plastic. The lid 22 has an opening through which a straw 24 can be inserted to allow drinking from the cup. An outer diameter of the lid would be such as to allow the cup 20 and the lid 22 (i.e., assembled drinking cup) to be slipped into the container 12 through the bottom opening thereof. Thus, an inner diameter of the bottom opening of the container 12 would be such to correspond to at least an outer diameter of the assembled drinking cup to be held in place by the first locking mechanism 18 within the container 12.

Figure 3:
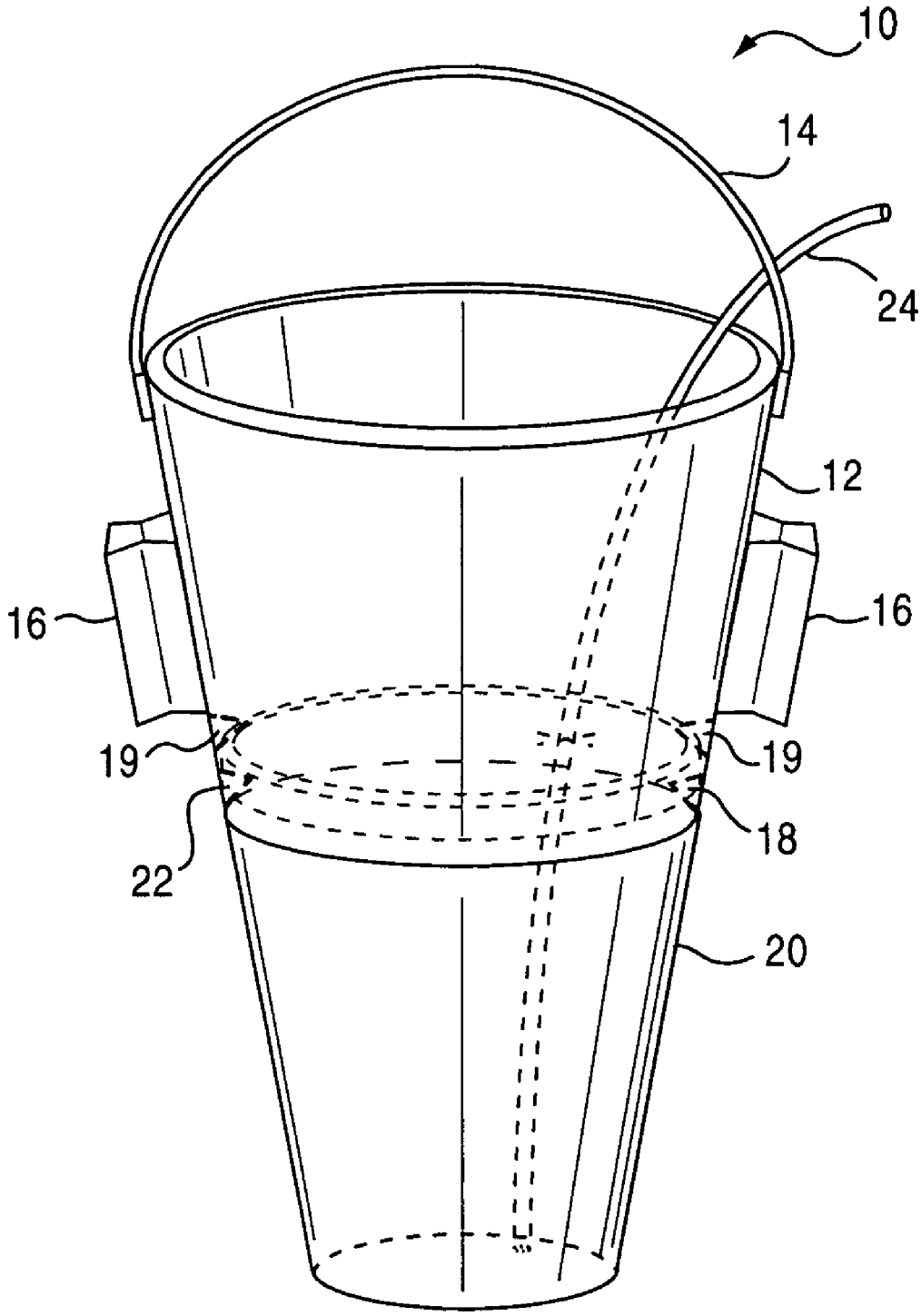
FIG. 3 illustrates the portable container fully assembled, in accordance with an embodiment of the present invention.

FIG. 3 illustrates the present invention in the assembled portable container 10, in accordance with an embodiment of the present invention. During assembly, the cup 20 is filled with any type of liquid or refreshment such as soft drink, beer, wine, etc. The cup is then closed with the lid.

If using the locking mechanism in the perforated form, each locking mechanism within the container 12 would be popped out in position to hold the assembled drinking cup. The assembled drinking cup is slipped into the container 12 through the bottom opening thereof and between the first locking mechanism 18 and the second locking mechanism 19. The assembled drinking cup is lowered so it latches between the first locking mechanism 18 and the second locking mechanism, where the first and second locking mechanisms 18 and 19 would support or hold the assembled drinking cup securely in place.

The present invention is now in full assembly enclosing the bottom opening of the container 12 using the assembled drinking cup. The straw 24 is then inserted through the opening of the lid. As illustrated in FIG. 3, the straw 24 would be configured to be long enough to allow a person to drink the soft drink from the cup 20 while the portable container is fully assembled. Thus, the straw 24 would be long enough to reach the bottom of the cup through the container 12.

Figure 4:
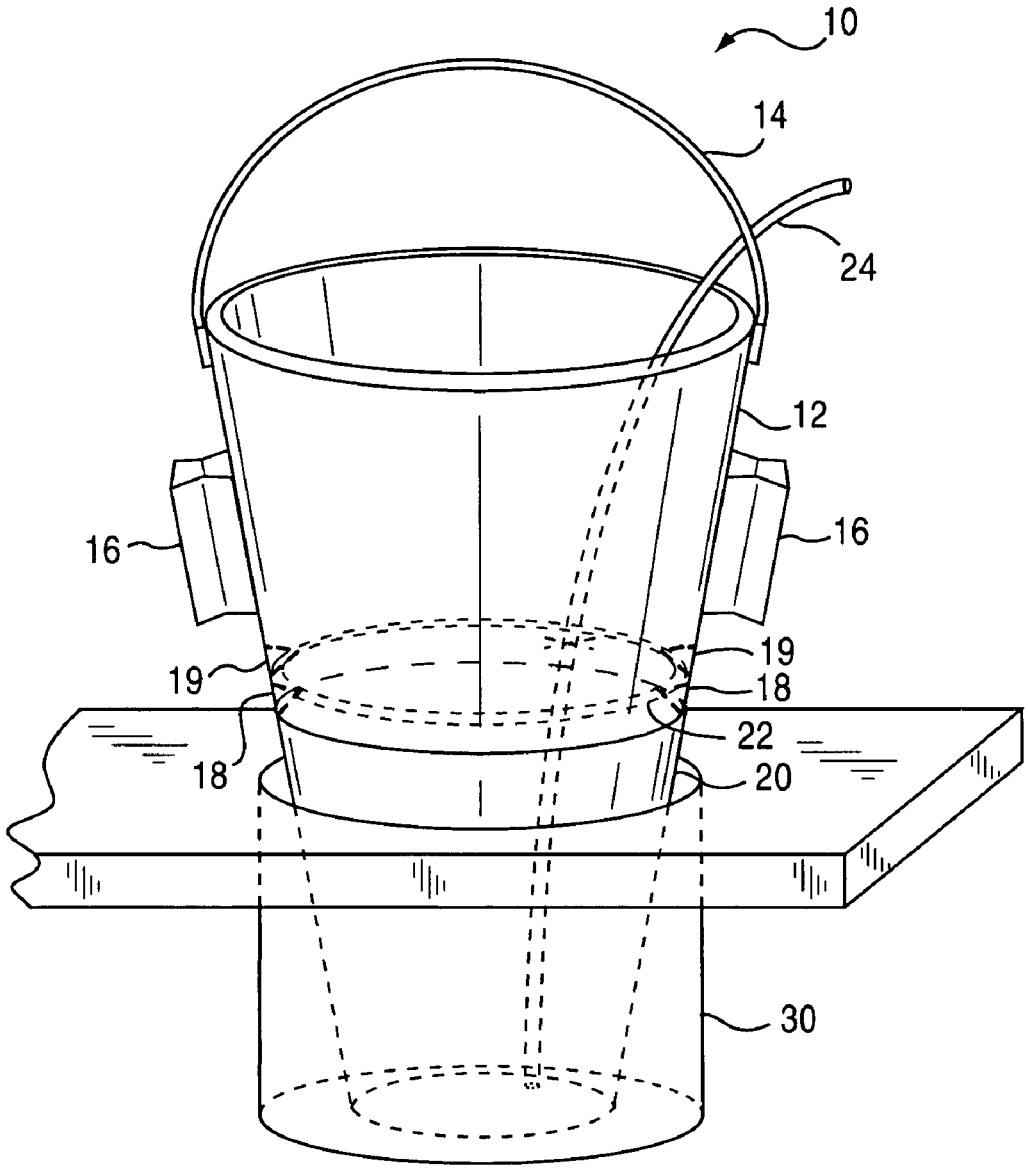
FIG. 4 illustrates the portable container fully assembled placed in a cup holder at a movie theater, for instance, in accordance with an embodiment of the present invention.

FIG. 4 illustrates the portable container 10 fully assembled placed in a cup holder at a movie theater, for instance, in accordance with an embodiment of the present invention. The container 12 is now ready to be filled with a snacking food such as popcorn. Also, candy may be inserted into each candy holder 16. Thus, the portable container 10 is configured to fit a cup holder 30 at a movie theater, a stadium, or the like. After use, the portable container 10 is disposable.

Figure 5A:
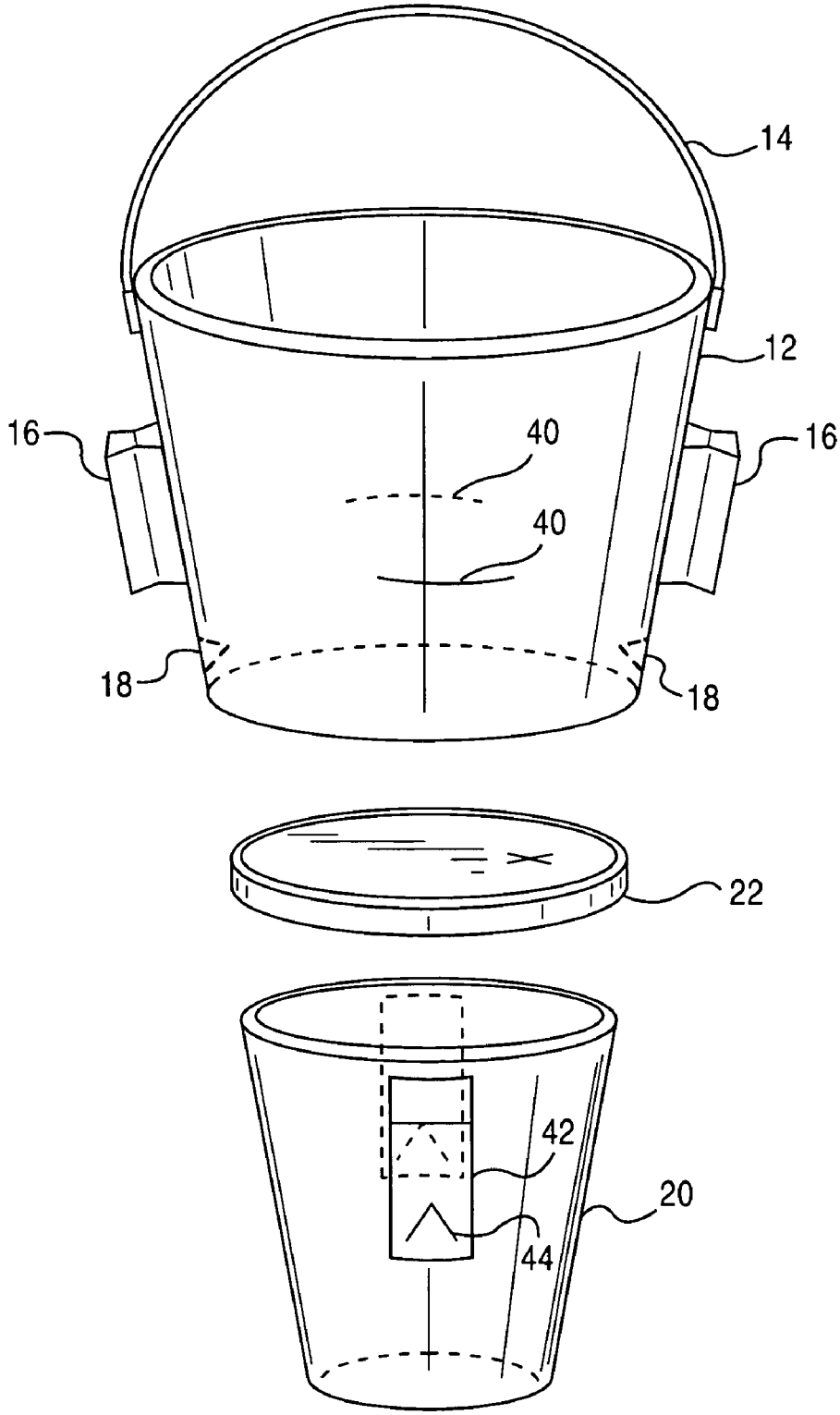
FIG. 5A illustrates the portable container using an alternative locking mechanism, in accordance with an embodiment of the present invention.

FIG. 5A illustrates the portable container using an alternative locking mechanism, in accordance with an embodiment of the present invention. In some instances, it may be desired to have a locking mechanism for large or heavier cups (i.e., plastic cups). Accordingly, FIG. 5A illustrates an embodiment including a second locking mechanism (including a slit 40, a first tab 42, and a second tab 44), which is configured to securely hold larger or heavier cups 20 to the container 12. As illustrated in FIG. 5A, the first locking mechanism 18 illustrated and described for FIGS. 1-4 is shown (i.e., first locking mechanism 18). Similarly to FIGS. 1-4, the container 12 may include the handle 14, the candy holder 16, and the first locking mechanism 18. In addition, at least two slits 40 would be cut on the container 12. In accordance with an embodiment of the present invention, the slits 40 would be cut on opposite sides of the container 12. The cup 20 would include first tabs 42 on opposite sides of the cup 20. Each first tab 42 includes pre-cut secondary tab 44. The number of first tabs 42 and second tabs 44 would correspond to the number of slits 40 on the container 12. In accordance with an embodiment of the present invention, one or more slits 40 and, therefore, one or more single first tabs 42 may be provided.

During assembly, the cup 20 would be filled with the soft drink and then closed with the lid 22. If using the first locking mechanism 18, the first locking mechanism 18 on the container 12 would be popped out in position. The assembled drinking cup are slipped into the container 12 through the bottom opening thereof and the first locking mechanism 18 supports or holds the assembled drinking cup in position. Then, each first tab 42 is lined up with each slit 40 on the container 12. The first tabs 42 would be pulled away from the container 12 and flipped in an upward direction. Each secondary tab 44 would be then inserted into the corresponding slit 40, thereby securing the assembled drinking cup to the container 12.

Figure 5B:
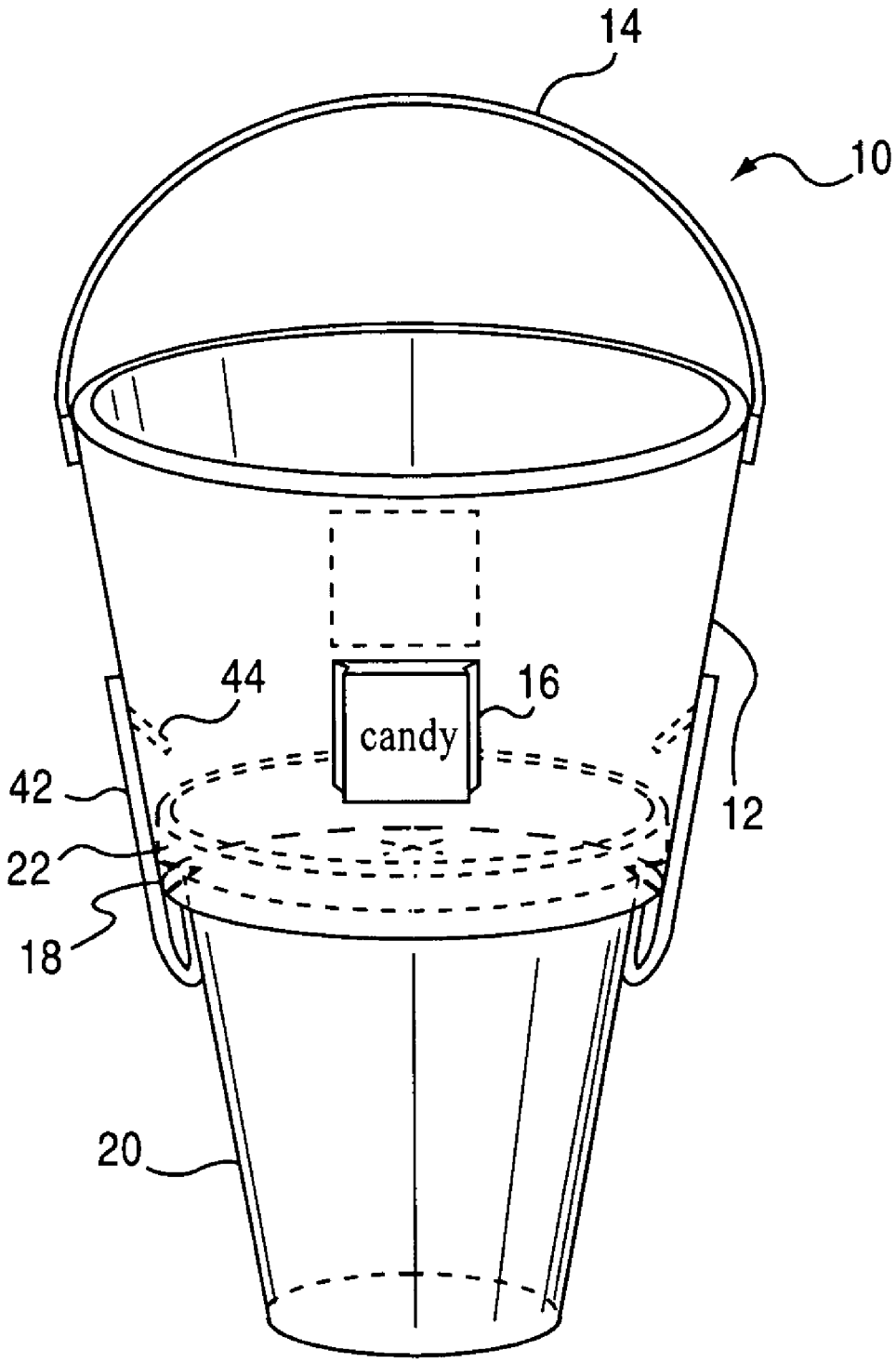
FIG. 5B illustrates the portable container fully assembled having first and second locking mechanisms, in accordance with an embodiment of the present invention.

FIG. 5B illustrates the alternative embodiment described in FIG. 5A rotated 90 degrees including the portable container 10 fully assembled having the first and second locking mechanisms 18, 40, 42, and 44, in accordance with an embodiment of the present invention. The second locking mechanism 40, 42, and 44 securely holds the assembled drinking cup to the container 12, making it an ideal arrangement for large or heavy cups, for instance. However, a person of ordinary skill in the art will appreciate that the portable container 10 may exclude the first locking mechanism and include the second holding mechanism.

Figure 6:
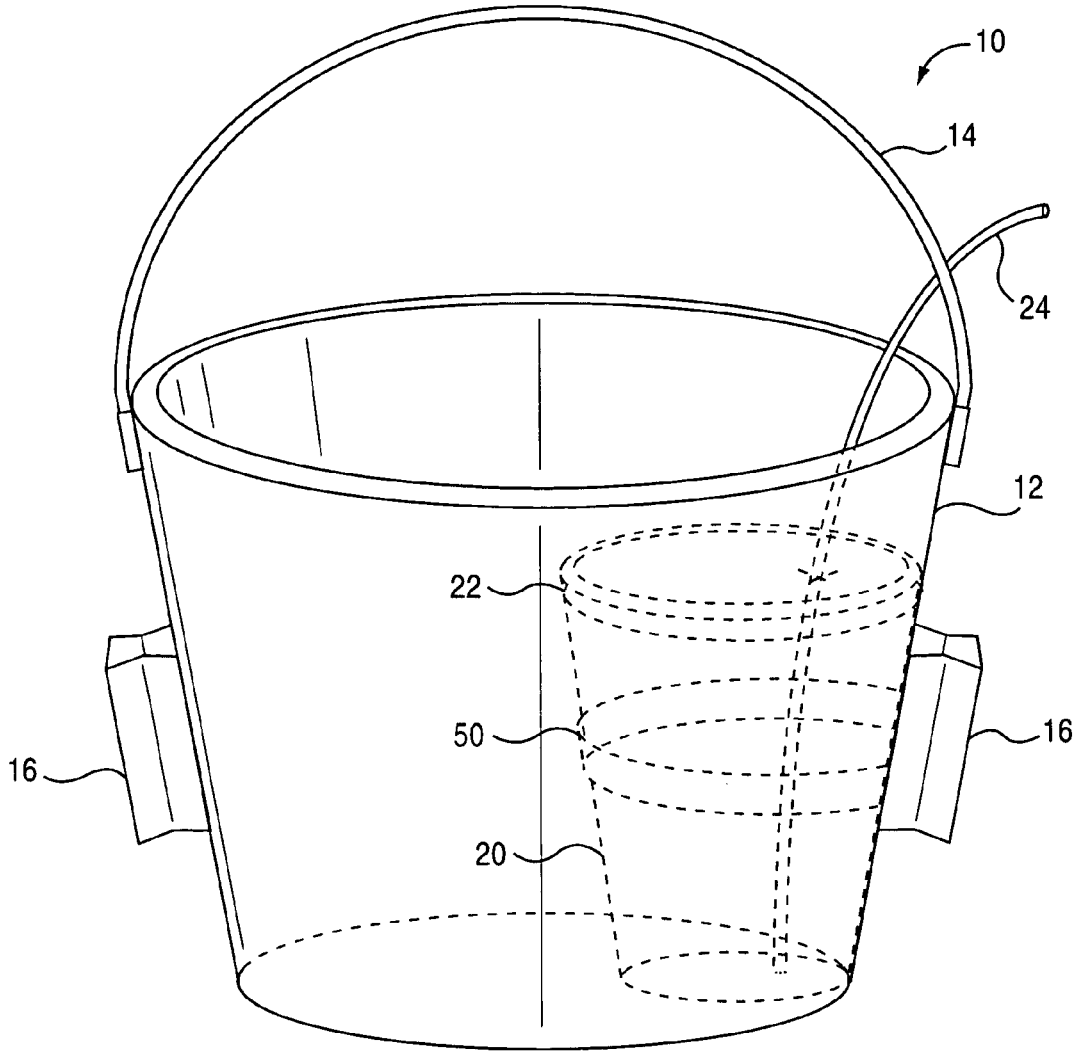
FIG. 6 illustrates a portable container including an alternative locking mechanism, in accordance with an embodiment of the present invention.

FIG. 6 illustrates an alternative portable container 10 including a container 12 having a trapezoidal cylindrical shape with a top opening and a base, in accordance with an embodiment of the present invention. The container 12 includes a handle 14 operatively attached to opposite sides of the container 12. A circumferential retainer 50 is provided which is attached to an inside wall of the container 12 and may be made of the same or different material as the container 12. To avoid the effect of condensation on the snack food to fill the container 12 from any liquid to fill the cup 20, either the retainer 50 and/or the cup 20 may be formed partially or completely out of an insulated material to insulate beverages. Any type of conventional insulated material may be used to form the retainer 50 and/or cup 20.

The inner diameter of the circumferential retainer 50 would correspond to at least the outer diameter of the cup 20 to be held in place within the container 12. The retainer 50 may be positioned at a predetermined distance from the base of the container 12. In one illustrative example, the retainer 50 is attached at a mid position of the container 12.

A person of ordinary skill in the art will appreciate that the thickness of the retainer 50 may vary, for instance, to equal to the height or full length of the cup 20. Also, a person of ordinary skill in the art will appreciate that a plurality of circumferential retainers may be provided to hold the cup 20. In addition, in accordance with an alternative embodiment, the retainer 50 may be configured to partially hold the cup 20 in place. Specifically, the retainer 50 may be shaped as a clamp or bracket using an adequate material, such as plastic, to hold the cup 20 inside the container 12 in place. Although the container 12 is illustrated as carrying only one cup, a person of ordinary skill in the art will appreciate that the size of the container 12 may be increase so as to include more than one retainer 50 to carry more than one cup 20.

Further, on opposite sides of the container 12, at least one pocket or candy holder 16 is provided. A lid 22 would cover and fastened onto the cup 20 and include an opening through which a straw 24 can be inserted for drinking.

Figure 7:
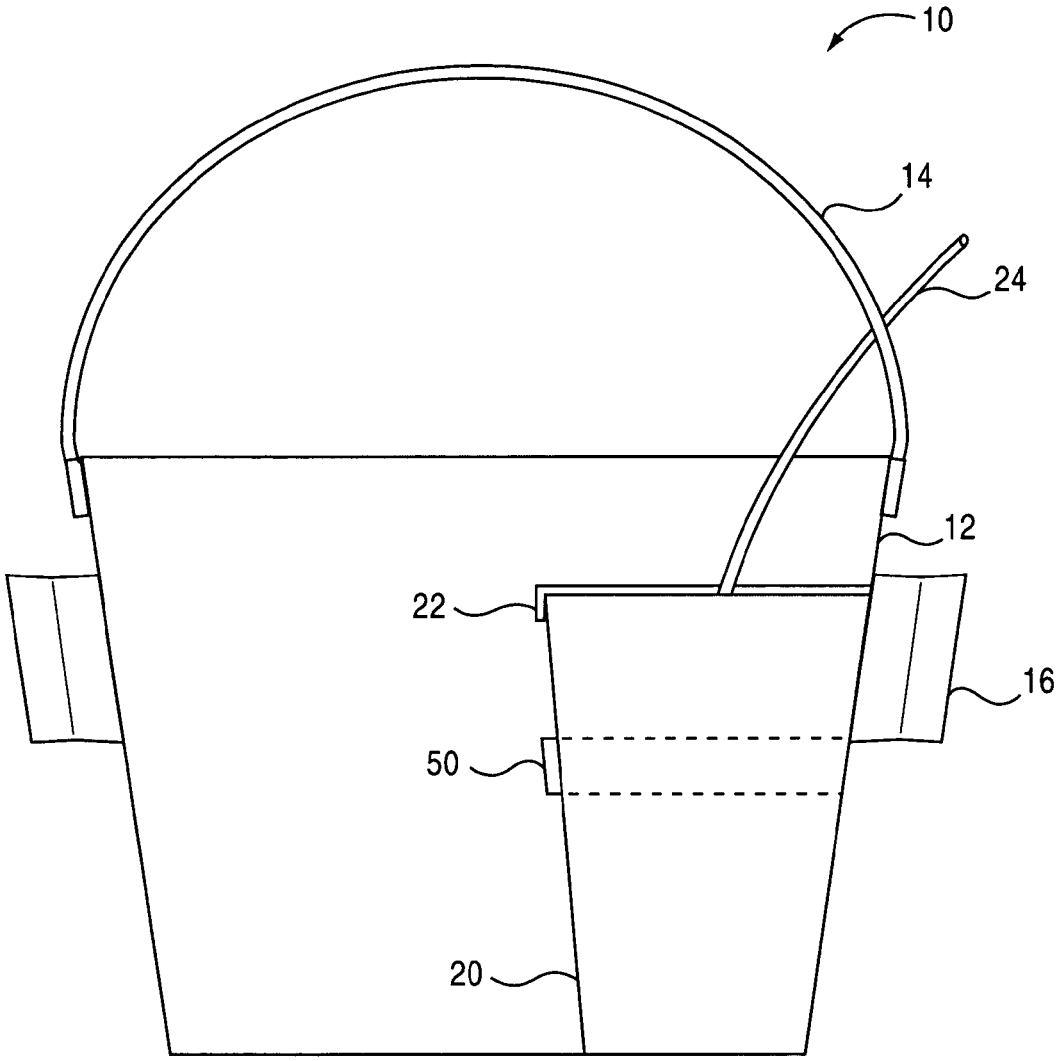
FIG. 7 illustrates a cross sectional view of the fully assembled portable container held in place by a retainer, in accordance with an embodiment of the present invention.
Figure 8:
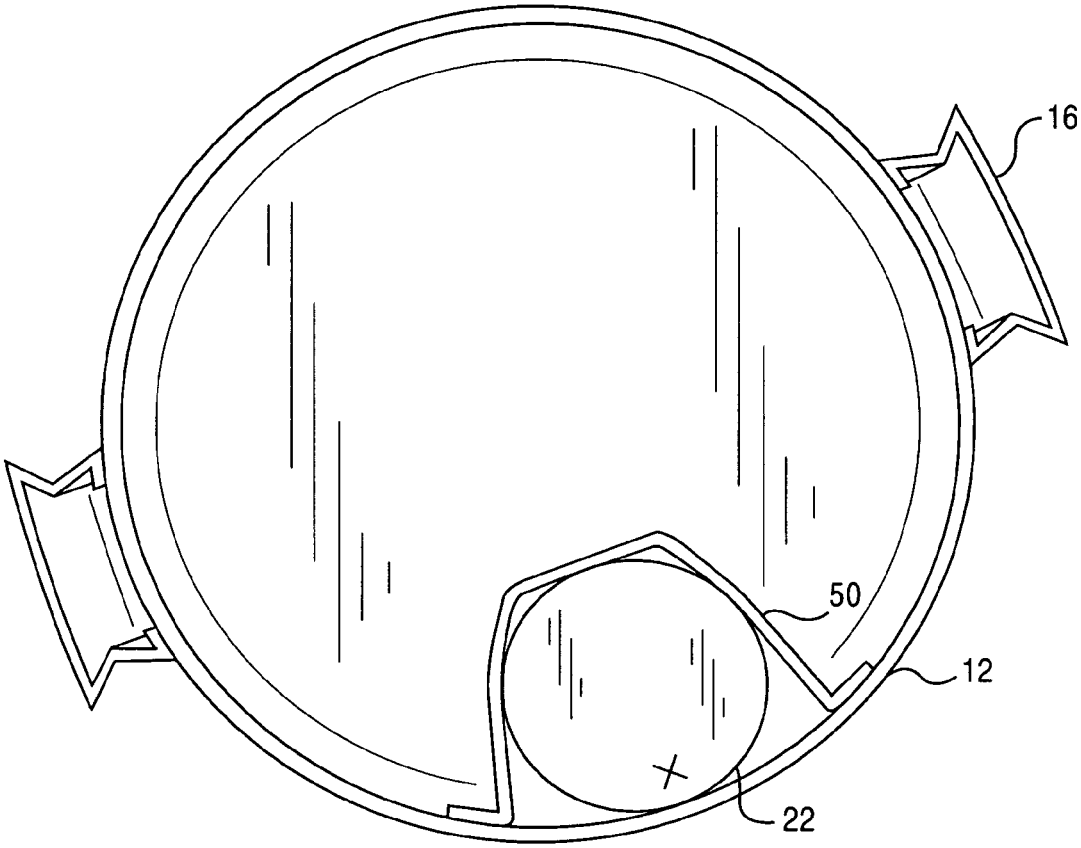
FIG. 8 illustrates a top view of the fully assembled portable container being held in place by the retainer, in accordance with an embodiment of the present invention.

FIG. 6 illustrates the present invention in full assembly of the portable container 10, in accordance with an embodiment of the present invention. FIG. 7 illustrates a cross sectional view of the fully assembled portable container 10 being held in place by the retainer 50, in accordance with an embodiment of the present invention. FIG. 8 illustrates a top view of the fully assembled portable container 10 being held in place by the retainer 50, in accordance with an embodiment of the present invention.

In essence, during assembly, the cup 20 is filled with a soft drink, for instance. The cup 20 is then closed with the lid 22. Then, the retainer 50 is extended and adjusted in position to hold the cup. The assembled drinking cup is positioned within the retainer 50, thereby securely holding the cup 20 in place. The straw 24 is then inserted through the opening of the lid 22. In this instance, the straw 22 would be long enough to reach the bottom of the cup 20. The container 12 is then filled with a snacking food, such as popcorn and candy may be inserted into each candy holder 16. After use, the portable container 10 is disposable.

Thus, the various embodiments describe herein of a portable container are configured to enable a person to carry soft drinks and snacks single hand reducing spills or waste. Also, some of the embodiments are configured to allow the portable container 10 to fit in a cup holder usually available in theaters, stadiums, and the like.

The present invention conforms to conventional forms of manufacture or any other conventional way known to one skilled in the art, and is of simple construction and is easy to use. The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed:

1. A portable assembly, comprising:

a container comprising top and bottom openings;

two locking mechanisms built on opposite sides of inner walls of the container, each having a notched shape, positioned at a predetermined distance from the bottom opening of the container, and configured to hold a vessel in place;

a pocket on an outside wall of the container configured to hold a dry snack;

a vessel;

a lid configured to cover and fasten onto the vessel, wherein the vessel and the lid are slipped into the container through the bottom opening, over the locking mechanism, and lowered so the vessel and the lid latch onto the two locking mechanisms supporting or holding the vessel and lid in place, wherein the vessel and the lid enclose the bottom opening of the container to allow the container to be filled with a snacking food; and a handle operatively attached to opposite sides of the container configured to enable a person to carry as a unit the container, the vessel, and the dry snack.

2. The portable assembly as recited in claim 1, wherein an outer diameter of the lid is configured to allow the vessel and the lid to be slipped into the container through the bottom opening.

3. The portable assembly as recited in claim 2, wherein an inner diameter of the bottom opening of the container is configured to correspond to at least an outer diameter of the vessel and the lid to be held in place by the two locking mechanisms within the container.

4. The portable assembly as recited in claim 1, wherein the lid has an opening through which a straw can be inserted to allow drinking from the vessel and the straw is configured to be long enough to allow a person to drink from the vessel while the two locking mechanisms are supporting or holding the vessel in place.

5. The portable assembly as recited in claim 1, wherein the top opening of the container has a wider diameter than the diameter of the bottom opening.

6. The portable assembly as recited in claim 1, wherein the container comprises a trapezoidal cylindrical shape.

7. The portable assembly as recited in claim 1, wherein the two locking mechanisms are built inside the walls of the container or are perforated on the container walls.

8. The portable assembly as recited in claim 6, wherein when the two locking mechanisms are perforated through the container walls, the perforations are pushed inwards of the container to form the two locking mechanisms within the container.

9. The portable assembly as recited in claim 1, wherein the portable assembly comprises three or more locking mechanisms on opposite sides of inner walls of the container.

10. The portable assembly as recited in claim 1, wherein, prior to assembly of the portable assembly for use, the pocket is in a folded position, and during assembly of the portable assembly, the pocket is outwardly extended.

11. The portable assembly as recited in claim 1, wherein the pocket is placed at a position along a circumference of the container and at a position along a vertical height from the bottom opening of the container.

12. The portable assembly as recited in claim 1, wherein at least two pockets are placed on the outside walls of the container.

13. A portable assembly, comprising:

a container comprising top and bottom openings;

a first locking mechanism comprising a slit cut on the container, and a first tab comprising a pre-cut secondary tab;

a pocket on an outside wall of the container configured to hold a dry snack;

a vessel;

a lid configured to cover and fasten onto the vessel, wherein the vessel and the lid are slipped into the container through the bottom opening, the first tab is lined up with the slit on the container, the first tab is pulled away from the container and flipped in an upward direction, and the secondary tab is inserted into the slit to secure the vessel to the container, wherein the vessel and the lid enclose the bottom opening of the container to allow the container to be filled with a snacking food; and a handle operatively attached to opposite sides of the container configured to enable a person to carry as a unit the container, the vessel, and the dry snack;

wherein an outer diameter of the lid is configured to allow the vessel and the lid to be slipped into the container through the bottom opening.

14. The portable assembly as recited in claim 13, wherein an inner diameter of the bottom opening of the container is configured to correspond to at least an outer diameter of the vessel and the lid to be held in place by the first locking mechanism within the container.

15. The portable assembly as recited in claim 13, further comprising:

a second locking mechanism having a notched shape positioned at a predetermined distance from the bottom opening of the container, wherein the vessel and the lid are slipped into the container through the bottom opening, over the locking mechanism, and lowered so the vessel and the lid latch onto the second locking mechanism.

16. The portable assembly as recited in claim 13, further comprising:

slits cut on opposite sides of the container; and first tabs each comprising a pre-cut secondary tab, wherein the number of first tabs and second tabs would correspond to the number of slits on the container.

17. The portable assembly as recited in claim 13, wherein the container comprises a trapezoidal cylindrical shape.

18. The portable assembly as recited in claim 13, wherein the lid has an opening through which a straw can be inserted to allow drinking from the vessel and the straw is configured to be long enough to allow a person to drink from the vessel while the first locking mechanism is securing the vessel in place.

19. A portable assembly, comprising:

container means comprising top and bottom openings;

two locking mechanism means built on opposite sides of inner walls of the container, each having a notched shape, positioned at a predetermined distance from the bottom opening of the container means, and configured to hold a vessel means in place;

holding means on an outside wall of the container means for holding a dry snack;

vessel means;

lid means for covering and fastening onto the vessel, wherein the vessel means and the lid means are slipped into the container means through the bottom opening, over the locking mechanism means, and lowered so the vessel means and the lid means latch onto the locking mechanism means for supporting or holding the vessel means and the lid means in place, wherein the vessel means and the lid means are provided for enclosing the bottom opening of the container means to allow the container means to be filled with a snacking food; and handle means operatively attached to opposite sides of the container means for enabling a person to carry as a unit the container means, the vessel means, and the dry snack.

20. A portable assembly, comprising:

container means comprising top and bottom openings;

first locking mechanism means comprising a slit cut on the container means, and a first tab comprising a pre-cut secondary tab;

pocket means on an outside wall of the container means for holding a dry snack;

vessel means;

lid means for covering and fastening onto the vessel means, wherein the vessel means and the lid means are slipped into the container means through the bottom opening, the first tab is lined up with the slit on the container means, the first tab is pulled away from the container means and flipped in an upward direction, and the secondary tab is inserted into the slit to secure the vessel means to the container means, wherein the vessel means and the lid means are provided for enclosing the bottom opening of the container means to allow the container means to be filled with a snacking food; and handle means operatively attached to opposite sides of the container for enabling a person to carry as a unit the container means, the vessel means, and the dry snack;

wherein an outer diameter of the lid is configured to allow the vessel means and the lid to be slipped into the container means through the bottom opening.

21. A portable assembly, comprising:

a container comprising top and bottom openings and straight slits on side walls thereof, wherein the straight slits are each configured to hold a vessel comprising a locking mechanism in place;

a locking mechanism having a notched shape positioned at a predetermined distance from the bottom opening of the container;

a pocket on an outside wall of the container configured to hold a dry snack;

a vessel comprising the locking mechanism at a predetermined distance from a top opening thereof;

a lid configured to cover and fasten onto the vessel, wherein the vessel and the lid are slipped into the container through the bottom opening of the container, and the locking mechanism of the vessel latches to the straight slits of the container having a shape to receive the locking mechanism, and the vessel latches to the container in place, wherein the vessel and the lid enclose the bottom opening of the container to allow the container to be filled with a snacking food; and a handle operatively attached to opposite sides of the container configured to enable a person to carry as a unit the container, the vessel, and the dry snack;

wherein an outer diameter of the lid is configured to allow the vessel and the lid to be slipped into the container through the bottom opening.

* * * * *